US005892529A

United States Patent [19]

Tatsuura et al.

[11] Patent Number: 5,892,529

[45] Date of Patent: Apr. 6, 1999

[54] IMAGE FORMING METHOD AND IMAGE FORMING APPARATUS INCLUDING ELECTROCONDUCTIVE POLYMER LAYER FOR DYE INTAKE AND RELEASE

[75] Inventors: Satoshi Tatsuura; Shigemi Ohtsu; Makoto Furuki; Lyong Sun Pu, all of Ashigarakami-gun, Japan

[73] Assignee: Fuji Xerox Co., Ltd., Tokyo, Japan

[21] Appl. No.: 816,027

[22] Filed: Mar. 11, 1997

[30] Foreign Application Priority Data

Mar. 15, 1996 [JP] Japan ..... 8-059407

[51] Int. Cl.[6] ..... B42J 2/385; G03G 13/04

[52] U.S. Cl. ..... 347/139; 347/139

[58] Field of Search ..... 347/139, 153; 428/522; 430/631

[56] References Cited

FOREIGN PATENT DOCUMENTS

A-2-142835 5/1990 Japan .
A-7-287491 10/1995 Japan .

OTHER PUBLICATIONS

Hiroaki Shinohara et al., "Ion–sieving of Electrosynthesized Polypyrrole Films" J. Chem. Soc., Chem. Commun., pp. 87–88 (1986).

Katsumi Yoshino, "Fundamentals and Applications of Electroconductive Polymers" *I.P.C.,* (1988).

Kazuo Yamashita et al., "Functions and Designs of Electroconductive Organic Films," *Surface Science Society of Japan* (*1988*).

Susumn Yoshimura, "Electroconductive Polymers", *Polymers Society of Japan* (*1987*).

*Primary Examiner*—N. Le
*Assistant Examiner*—L. Anderson
*Attorney, Agent, or Firm*—Oliff & Berridge, PLC

[57] ABSTRACT

An image forming method and an image forming apparatus, wherein a thin film of an electroconductive polymer which holds and releases a dye by means of an electric field enables a construction including a driving circuit, a driving device and an image forming medium to be used for the transfer of an image pattern. The image forming method includes forming a thin film of the electroconductive polymer on an electroconductive substrate, which can take in, hold and release ionic dye molecules in accordance with the change of the state of the electroconductive polymer, that can assume at least two physicochemical states among an oxidized state, a neutral state and a reduced state of the thin film; and bringing the thin film into contact with an image receiving medium. The image receiving medium has suppressed electroconductivity. When a voltage is applied to the thin film holding ionic dye molecules and the image receiving medium between the electroconductive substrate and an image formation controlling electrode, ionic dye molecules are transferred to a localized area, but not to the entire surface, of the image receiving medium.

22 Claims, 13 Drawing Sheets

POTENTIAL VERSUS SATURATED CALOMEL ELECTRODE

POTENTIAL VERSUS SATURATED CALOMEL ELECTRODE

IMAGE FORMING METHOD AND IMAGE FORMING APPARATUS INCLUDING ELECTROCONDUCTIVE POLYMER LAYER FOR DYE INTAKE AND RELEASE

BACKGROUND OF THE INVENTION

1. Field of the Invention

The present invention relates to an image forming method and to an image forming apparatus. More particularly, the present invention relates to an image forming method and to an image forming apparatus by use of an electroconductive polymer layer which takes in a dye and release the dye.

2. Description of the Related Art

Methods, which are currently utilized in a printer or the like for the purpose of transferring an image from an electric signal or optical signal to a recording medium such as paper, include, for example, dot-impacting, thermal transfer, thermal sublimation, ink jet and laser printing methods in electrostatic photography. These methods are roughly divided into three groups.

The methods, which are included in the first group, are those based on dot-impacting, thermal transfer and thermal sublimation. According to these methods, a sheet, which is in the form of an ink ribbon or a donor film and which contains a dispersed dye, is superposed on a paper or the like and the dye is transferred to the paper by the application of a mechanical impact or heat. Therefore, these methods always need expendable supplies and are associated with such disadvantages as high running costs due to difficulty in high-speed operation and poor energy efficiency. Further, the qualities of images are poor except for those obtained by the thermal sublimation method.

An ink jet method, which is included in the second group and is based on the mechanism that the ink is directly transferred to a paper from a head, is characterized by a low level of running costs, because no expendable supplies are necessary except for ink. However, the ink jet method is associated with a difficulty in high-speed operation, because it is difficult to electrically control all of the dots and to form a head corresponding to the width of a paper. Other disadvantages are that the minimal image unit is restricted by the size and interval of heads and that the printing speed decreases and the energy efficiency becomes poor with improving print quality.

An electrostatic photographic method such as a laser-printing method, which is included in the third group, is based on the mechanism that an image is formed via an intermediate transferring member. That is, according to an electrostatic photographic method, toner particles are caused to adhere to an electrostatic latent image created by laser spots and then the toner particles are transferred to a paper to forman image. This method is featured by a capability to form a relatively fine image and by a low level of running costs, because no expendable supplies are necessary except for toner. However, this method is associated with the problem that a high voltage is necessary for forming an electrostatic latent image and for adhering/transferring toner particles. Further, a large amount of electricity is consumed and, therefore, ozone and nitrogen oxides are generated. Furthermore, all of the above-mentioned printing methods generate noisy sounds when the printers are operated.

On the other hand, other conventional image forming methods, such as an ordinary printing method and a silver salt photographic method, provide images with high quality.

The ordinary printing method, which involves the formation of a printing plate and provides low running costs in the case that a number of identical images are formed, is not suitable for general uses. In the case of a silver salt photographic method, media, which are not reusable, such as photographic films and papers, need to be employed so that the running costs are high and a high-speed operation of the method is impossible.

As stated in the above, none of aforementioned methods, in which an image from an electric signal or optical signal is transferred to a recording medium such as paper, can provide a desirous method featured by a high-quality image, a relatively high speed, a low level of running costs, energy saving, resource saving and advantage both to environment and to users.

A conceivable means to solve the above-mentioned problems is the utilization of an image forming medium which can form and transfer or directly form an image distribution created by image forming elements such as toner particles or ink corresponding to an object image in such a manner that the image distribution is in the same scale (the same width) as that of an image receiving medium (such as a paper) onto which the image is transferred. Although this medium also functions as a temporary carrying member of the image forming elements, the intake or release (delivery) of the image forming elements needs to be performed with relatively low energy and a continuous gradation. Another required function is that the unit of the image forming element be minimized.

An image forming medium, which is considered to have the above-mentioned functions, is an electroconductive polymer layer represented, for example, by polypyrrole, polythiophene and polyaniline. It has been known that the three states, i.e., oxidized state, neutral state and reduced state, of this type of polymer layer can be controlled chemically, electrically or electrochemically so that doping or dedoping of a counter ion takes place. The details of these characteristics are shown, for example, "Electroconductive Polymers" by S. Yoshimura (Polymers Society of Japan), "Functions and Designs of Electroconductive Organic Films" by K. Yamashita and H. Kitani (Surface Science Society of Japan) and "Fundamentals and Applications of Electroconductive Polymers" by K. Yoshino (I.P.C.). In short, if an ion itself, which is doped into and dedoped from an electroconductive polymer layer is a sort of image forming element, the ion is expected to exhibit its ability as a temporary carrying member of the image forming elements that fulfill the aforementioned requirements.

One of the problems, however, is that the counter ions which are doped into and dedoped from an electroconductive polymer are those which cannot be expected to become an image forming element, such as usual metals or anions and cations of electrolytes having a low molecular weight. Another problem is that, if an electroconductive polymer is synthesized in the presence of a high molecular weight anion, for example, such an anion cannot be dedoped from the polymer.

According to H. Shinohara et al., described in J. Chem. Soc., Chem, Commun, pp. 87 (1986), the size of an ion, which can be reversibly doped/dedoped, is determined by the microstructure of an electroconductive layer and is controllable, for example, by the size of a counter ion present at the time when the electroconductive polymer is polymerized from a monomer. This report, however, deals with ions having a molecular weight up to about 100 and discloses that the doping/dedoping characteristic becomes insufficient as the molecular weight increases. H. Shinohara et al. also report, in Journal of Chemical Society of Japan, No. 3, pp. 465 (1986), glutamic acid as a relatively large molecule that exhibits a reversible doping/dedoping characteristic, but this molecular weight is still below 150. Meanwhile, a dye generally used, which can be expected to be an image forming element, has a molecular weight mostly in the range of 500 to 1,500. Heretofore, a substance having this level of molecular weight has never been thought to be capable of being doped/dedoped reversibly.

It has been known that an ion having a small molecular weight, as mentioned above, is subjected to doping into and dedoping from an electroconductive polymer layer in order to utilize a color change accompanied by the doping and dedoping. However, this kind of technique has been centered on such applications as protective coatings for battery or solar cell and electrochromic displays. Therefore, none of these techniques has been used to replace a conventional image forming method.

One of a few examples of a known technique, whereby an electroconductive polymer itself is used as a material related to a marking application, is disclosed in Japanese Patent Application Laid-Open (JP-A) No. 2-142,835 titled "A method for controlling wettability of a thin film surface of a polymer and an image forming method and an image forming material utilizing said method". According to this technique, a printing plate is prepared by electrically switching a difference in the wettability between an oxidized state and a neutral state of the electroconductive polymer layer. Therefore, none of image forming elements (such as ink) is held within the electroconductive polymer layer by way of doping. Further, an adhered amount or transferred amount of a dye such as ink cannot be controlled by this technique.

Based on the above-described background, the present applicant has already filed an application of an invention providing an image forming method and an image forming apparatus and a thin film of an electroconductive polymer usable therefor, which are featured by such advantages as a high-quality image, a relatively high speed, a low running cost, energy saving, resource saving and usefulness both to environmental preservation and to users (Japanese Patent Application No. 7-287,491 filed on Nov. 6, 1995, which is hereinafter simply referred to as "the prior application").

According to the invention of the prior application, a thin film of an electroconductive polymer is utilized for the purpose of providing an image forming medium, where an ionic dye is taken in among molecules of the thin film of the electroconductive polymer in at least one state of the electroconductive polymer capable of changing between at least two states of an oxidized state, a neutral state and a reduced state. This thin film of an electroconductive polymer is formed on an electroconductive substrate (the same as "electrode substrate" in the prior application) and is controlled in an oxidized state or in a reduced state corresponding to a target image so that a distribution of concentration in accordance with an intaken amount or a released amount of the ionic dye corresponding to the target image is formed on the thin film of the polymer. The distribution of concentration of the ionic dye thus formed is transferred to an image receiving medium onto which an image is transferred (the same as "recording medium" in the prior application) (for convenience, a medium consisting of an electroconductive substrate and the above-mentioned electroconductive polymer formed on the substrate is herein referred to as "an image forming medium").

Most generally, the transfer is conducted by the steps comprising bringing a thin film of an electroconductive polymer formed on an electroconductive substrate into close contact with an image receiving medium provided with an electroconductivity and applying an electric field between the thin film of the electroconductive polymer and the image receiving medium.

According to the method proposed by the prior application, the transfer of the dye in the form of a pattern was conducted in the following process.

The process comprised the steps of forming an image forming medium having a complex construction where a thin film of an electroconductive polymer was formed on each of a plurality of fine electroconductive substrates (fine electrodes) and then applying a voltage independently to each of the fine electrodes in conformity with an image pattern. Accordingly, the construction comprising a driving circuit, a driving means and an image forming medium was complex. In addition, an independent design was necessary for the driving circuit and the driving means.

SUMMARY OF THE INVENTION

Accordingly, a first object of the present invention is to provide an image forming method which utilizes the image forming method of the prior application comprising the utilization of a thin film of an electroconductive polymer capable of holding or releasing a dye depending on an electric field and which can remarkably simplify the construction of a driving circuit, a driving means and an image forming medium for the transfer of an image pattern and which can utilize the structural elements currently used for image forming apparatus (e.g., a printer using thermal transfer method).

A second object of the present invention is to provide an image forming apparatus suitable for the above-mentioned method.

The first object of the present invention can be achieved by an image forming method comprising the steps of forming a thin film of an electroconductive polymer, formed on an electroconductive substrate, which is capable of taking in, holding and releasing an ionic dye molecule in accordance with the change in the state of the electroconductive polymer capable of assuming at least two physicochemical states among an oxidized state, a neutral state and a reduced state, bringing the thin film of the electroconductive polymer into contact with an image receiving medium, which is subjected to transfer of the ionic dye molecule and has a suppressed electroconductivity, and applying a voltage corresponding to an image signal, to an image formation controlling electrode arranged so as to interpose the thin film of the electroconductive polymer holding the ionic dye molecule and the image receiving medium between the image formation controlling electrode and the electroconductive substrate in order to release and transfer the ionic dye molecule being held in the thin film of the electroconductive polymer, to the image receiving medium so that a dye image is formed.

In the method of the present invention, as an image receiving medium, a medium having a suppressed electroconductivity is utilized. Therefore, when a voltage is applied from an image formation controlling electrode and an electroconductive substrate (instituting the other electrode) to the thin film of the electroconductive polymer and the image receiving medium placed between the image formation electrode and the electroconductive substrate, a certain electric field is applied not to the entire area of the image receiving medium but to only the area interposed between the electrodes or the periphery thereof, namely a localized area, so that the dye is locally released from the thin film of the electroconductive polymer to the image receiving medium. Therefore, by the use of an electrode, which corresponds to the image pattern to be transferred or which can be scanned in conformity with the image pattern to be transferred, as the-image formation controlling electrode, a desired image can be easily transferred. This process can remarkably simplify the construction of a driving circuit, a driving means and an image forming medium.

The second object of the present invention can be achieved by an image forming apparatus comprising an image forming medium, which comprises an electroconductive substrate and a thin film of an electroconductive polymer which is formed on the electroconductive substrate and is capable of taking in and holding or releasing an ionic dye in accordance with the change in the state of the electroconductive polymer capable of assuming at least two physicochemical states among an oxidized state, a neutral state and a reduced state, an image receiving medium, which can be brought into contact with the thin film of the electroconductive polymer and which is subjected to transfer of the ionic dye molecule and has a suppressed electroconductivity, and an image formation controlling electrode arranged to interpose the thin film of the electroconductive polymer holing the ionic dye molecule and the image receiving medium between the image formation controlling electrode and the electroconductive substrate.

By use of this apparatus, it is possible to implement the aforementioned useful method.

DESCRIPTION OF THE PREFERRED EMBODIMENTS

Figure 1:
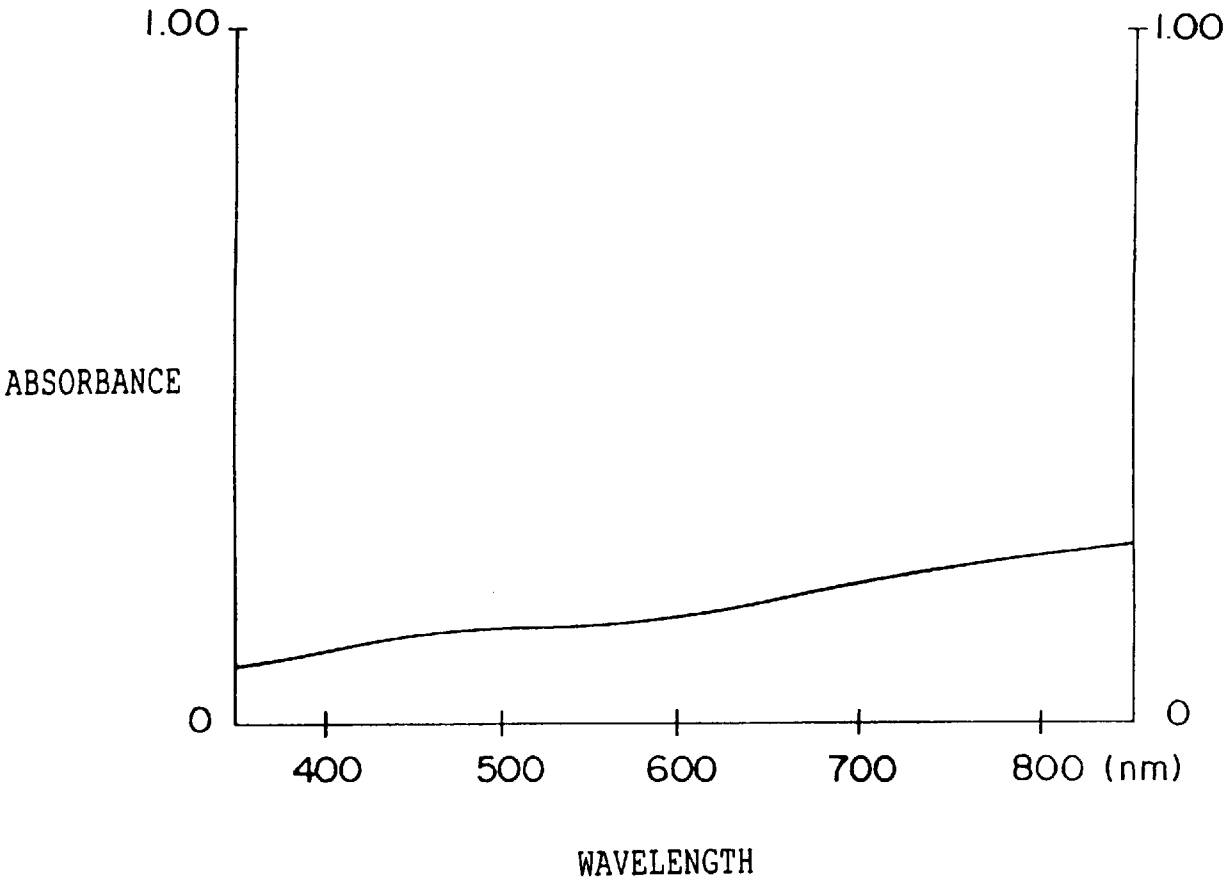
FIG. 1 shows absorption spectra of a polypyrrole film formed on ITO by carrying out polymerization in the presence of NaCl.

The present invention is explained in detail below.

First, an image forming medium, which is used in the image forming method and image forming apparatus of the present invention, is explained.

The image forming medium has a basic construction having an electroconductive substrate and a thin film of an electroconductive polymer which is formed on the substrate and which can change the state between at least two physicochemical states of an oxidized state, a neutral state and a reduced state and which takes in an ionic dye molecule among the molecules in at least one state of the electroconductive polymer.

The thin film of an electroconductive polymer can be of any type only if it can be electrochemically oxidized or reduced so that the doping and the dedoping of the ionic dye are possible. Examples of the thin film of the electroconductive polymers include a variety of one-dimensional electroconductive polymers such as polyacetylenes, polydiacetylenes, polyheptadienes, polypyrroles, polythiophenes, polyanilines, polyphenylene vinylenes, polythiophenylene vinylenes, polyisothianaphthenes, polysionaphthothiophenes, polyparaphenylenes, polyphenylene sulfides, polyphenylene oxides, polyfurans, polyphenanthrenes, polyselenophenes, polytellurophenes, polyazulenes, polyindenes, polyindoles, polyphthalocyanines, polyacenes, polyacenoacenes, polynaphthylenes, polyanthracenes, polyperinaphthalenes, polyperiphenylenes, polypyridinopyridines, polycyandienes, polyallenemetanoids and the like, or otherwise so-called ladder polymers or pyropolymers or two-dimensional electroconductive polymers such as graphite.

Almost all of ionic dye molecules can be used as the dyes which can be taken into the thin film of the electroconductive polymer. Examples of the dyes are synthetic dyes such as acridines, azaphthalides, azines, azuleniums, azos, azomethines, anilines, amidiniums, alizarins, anthraquinones, isoindolines, indigos, indigoids, indoanilines, indolyl phthalides, oxazines, carotenoids, xanthines, quinacridones, quinazolines, quinophthalones, quinolines, guanidines, chrome chelates, chlorophylls, kentone imines, diazos, cyanines, dioxazines, disazos, diphenyl methane, diphenyl amines, squaliriums, spiropyrans, thiazines, thioindigos, thiopyriliums, thiofluoranes, triallyl methanes, trisazotriphenyl methane, triphenyl methane, triphenyl methane phthalides, naphthalocyanines, naphthoquinones, naphthols, nitrosos, bisazooxadiazoles, bisazos, bisazostilbenes, bisazohydroxyperinone, bisazofluorenones, bisphenols, bislactones, pyrazolones, phenoxazines, phenothiazines, phthalocyanines, fluoranes, fluorenes, flugids, perinones, perylenes, benzimidazolones, benzopyranes, polymethines, porphyllines, methines, mellocyanines, monoazos, leucoauramine, leucoxanthene, rhodamine and the like, or otherwise a natural dye such as turmeric, gardenia, red malt, scallion, grape vine, beet, beefsteak plant, berry, corn, cabbage, cacao and the like. A suitable dye needs to be selected in light of such factors as the solubility of dyes in accordance with conditions such as the properties of the thin film of an electroconductive polymer to be used and a solvent to be used for the process.

The thin film of an electroconductive polymer layer described above can be prepared by electrolytic polymerization. Generally, according to an electrolytic polymerization process, a monomer as a raw material used for preparing a thin film of an electroconductive polymer, typically an aromatic compound having a low molecular weight, is electrochemically polymerized to form the thin film of the electroconductive polymer on a substrate. Electrolytically reductive polymerization can be applicable to some halogenated aromatic compound. The thin film of the electroconductive polymer thus produced by electrolytic polymerization, grows to take in a counter ion while maintaining an electrically neutral state during electrolytic polymerization. For example, if the potential of the electrode (electroconductive substrate) is made positive to carry out oxidative electrolytic polymerization to form a thin film of an electroconductive polymer, the thin film is formed on the electroconductive substrate in which an anion in an oxidized state is being doped in the thin film. This thin film of the electroconductive polymer is made neutral if the potential is made negative and releases the anion, which has been taken in, to keep an electrical neutrality, and thus the dedoping is effected. In the case of some thin films of electroconductive polymers exemplified by a polythiophene, if the potential is further made negative, a reduced state is attained and a cation is taken in the polymer film to maintain an electrical neutrality. The dedoping of the cation which has been taken in is performed if a neutrality is regained by making the potential positive.

Typically, the thin film of an electroconductive polymer, which is at least capable of being doped with an ionic dye molecule, can be produced by polymerizing a monomer which constitutes the electroconductive polymer in the presence of an ionic dye molecule or of a substance having a property and molecular weight equivalent to those of the ionic dye molecule. As a method for producing the electroconductive polymer, an electrolytic polymerization is most preferable. In the case where a monomer which constitutes the electroconductive polymer is polymerized in the presence of a substance, whose characteristics, such as ionic property (substituent), steric structure, molecular weight and the like, are close to those of an ionic dye molecule, a polymer film can be formed which is capable of being doped or dedoped with an ionic dye molecule.

In comparison with other thin films of electroconductive polymers which are prepared in the presence of an ion having a smaller molecular weight, the thin film of an electroconductive polymer obtained in the above-described manner can reversibly be doped or dedoped with a larger amount of an ionic dye molecule resulting from the electrochemical oxidation or reduction thereof. Therefore, the thin film of the electroconductive polymer does not always require to be doped with an ionic dye molecule in the case where the thin film is prepared from the electroconductive polymer (powder or solution), except for the state where the thin film is formed on an electroconductive substrate serving as an electrode.

In addition to the above-described electrolytic polymerization based on electrochemistry, a variety of methods can be employed for the formation of a thin film of an electroconductive polymer. These methods include chemical polymerization by use of an initiator such as a catalyst in a vapor phase, liquid phase or solid phase, followed by a process such as coating, or a modifying process such as pyrochemical process by use of a catalyst or sintering.

The image forming method including the utilization of the above-described image forming media of the present invention basically uses the principle proposed by the prior application.

The principle is explained below. According to the principle, ion-doped states which differ from each other depending on at least the states, i.e., oxidized state, neutral state and reduced state, of the thin film of an electroconductive polymer are utilized. That is, an anion or cation, which can be doped into or dedoped from the polymer, is an anionic or cationic dye molecule. As a result, the thin film of the electroconductive polymer can take in and hold the ionic dye molecule in a reversible manner or can release the ionic dye molecule from the thin film of the electroconductive polymer to transfer the dye molecule to an image receiving medium such as paper. The doped amount of the ion into the thin film of the electroconductive polymer depends on the potential and the time period of the application of an electric current, i.e., the amount of charge.

Accordingly, if a control system is set up so that the doping of the dye starts at a threshold potential or above, the concentration of the dye molecule in the thin film of the electroconductive polymer can be controlled in a continuous manner by controlling the amount of charge. Likewise, if a control system is set up so that the dedoping of the dye starts at a threshold potential or above, the concentration of the dye molecule to be released from the thin film of the electroconductive polymer can be controlled in a continuous manner by controlling the amount of charge. Further, if a distribution of potential is provided to the thin film of the electroconductive polymer or to the substrate electrode, an ionic dye can selectively be taken into the thin film of the electroconductive polymer or can selectively be released from the thin film of the electroconductive polymer.

An image receiving medium, on which an image is formed as a result of dedoping of the dye molecule from the thin film of an electroconductive polymer and which is one of the features of the present invention, will be explained later.

An embodiment of an image forming medium, which comprises a substrate and a thin film of an electroconductive polymer formed on the substrate and which is capable of being doped or dedoped, is explained below.

Figure 2:
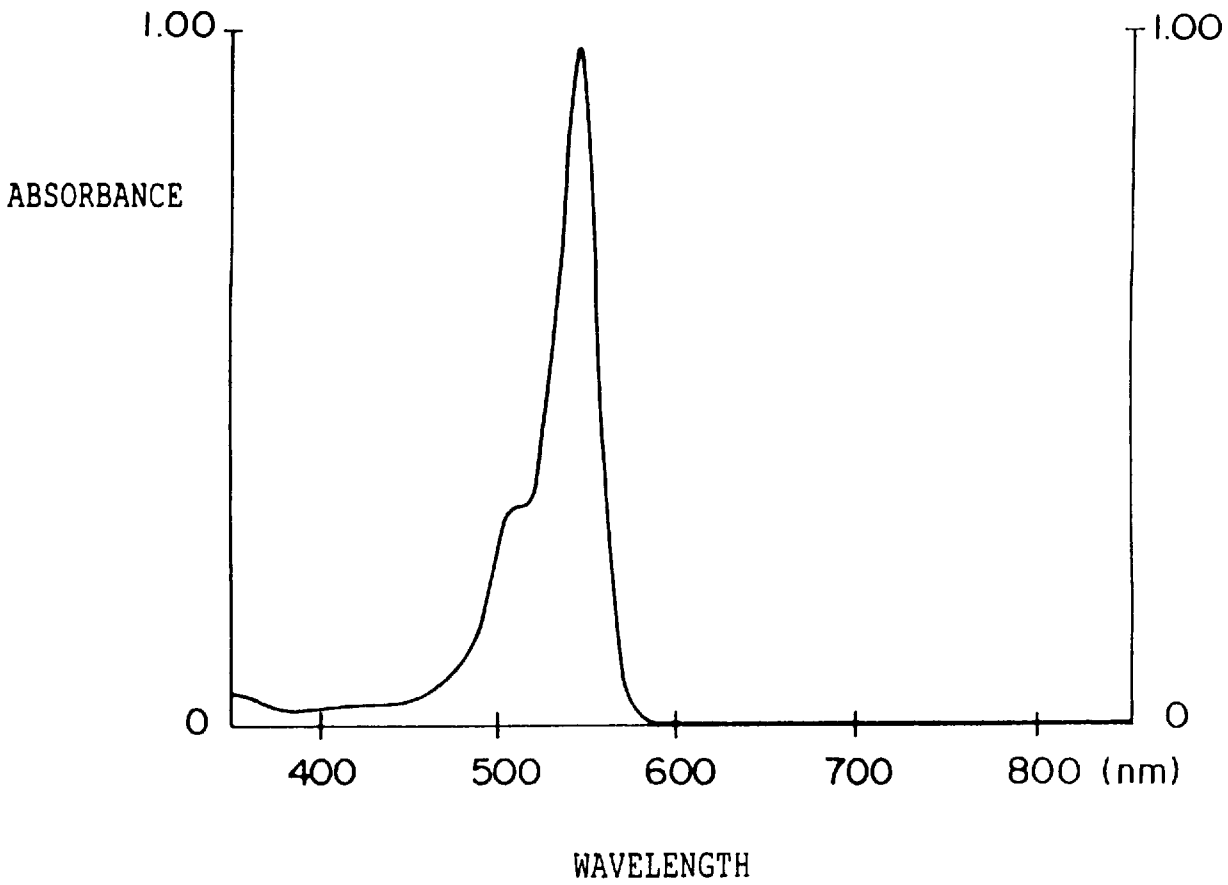
FIG. 2 shows absorption spectra of an aqueous solution of rose bengal.
Figure 3:
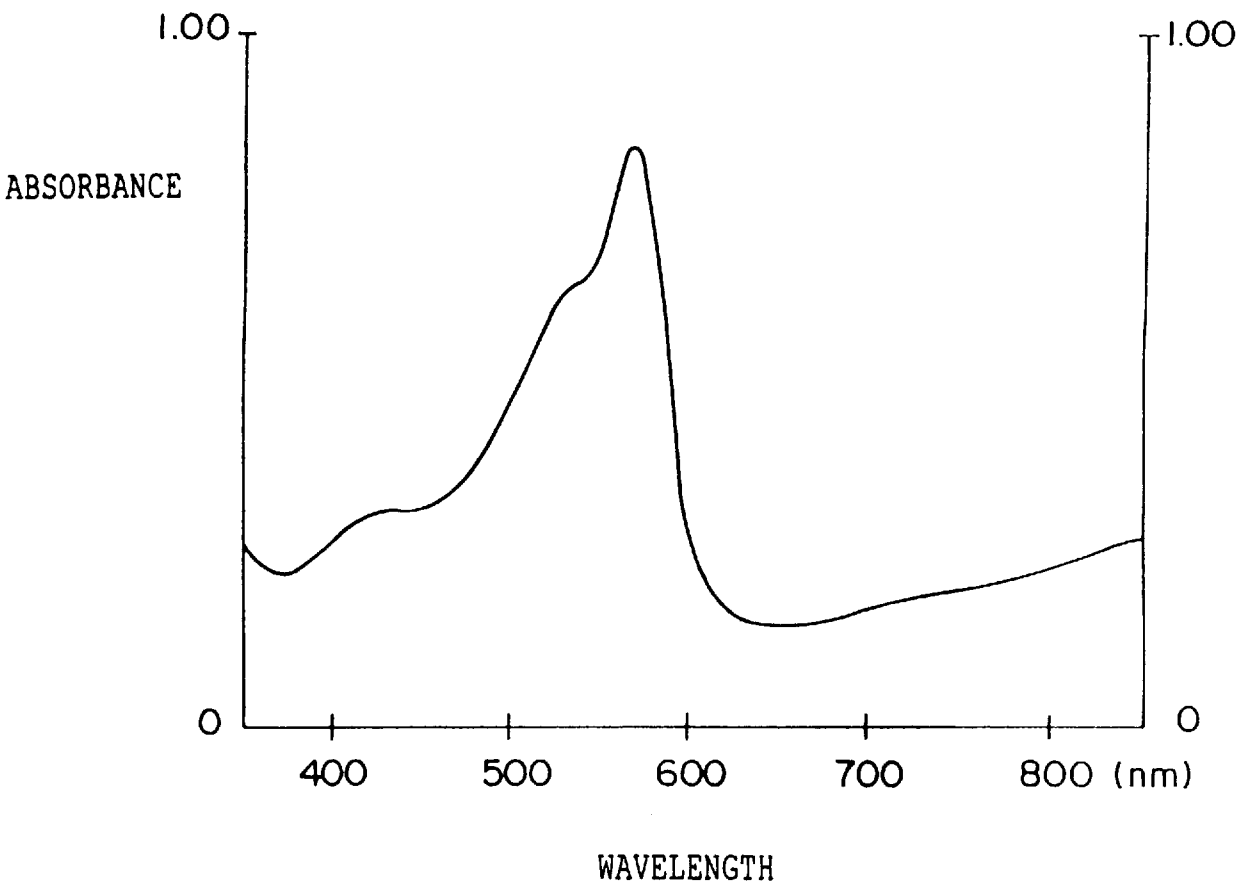
FIG. 3 shows absorption spectra of a polypyrrole film formed on ITO by carrying out polymerization in the presence of rose bengal.

FIG. 1 shows absorption spectra of a thin film of an electroconductive polymer (a polypyrrole film) formed on ITO (indium tin oxide) by polymerization in the presence of NaCl. FIG. 2 shows absorption spectra of an aqueous solution of rose bengal. FIG. 3 shows absorption spectra of a thin film of an electroconductive polymer (a polypyrrole film) formed on ITO by polymerization in the presence of rose bengal. FIG. 3 shows an absorption peak at 560 nm which is not observed in FIG. 1, thereby indicating that the rose bengal has been taken into the polypyrrole film.

Figure 4:
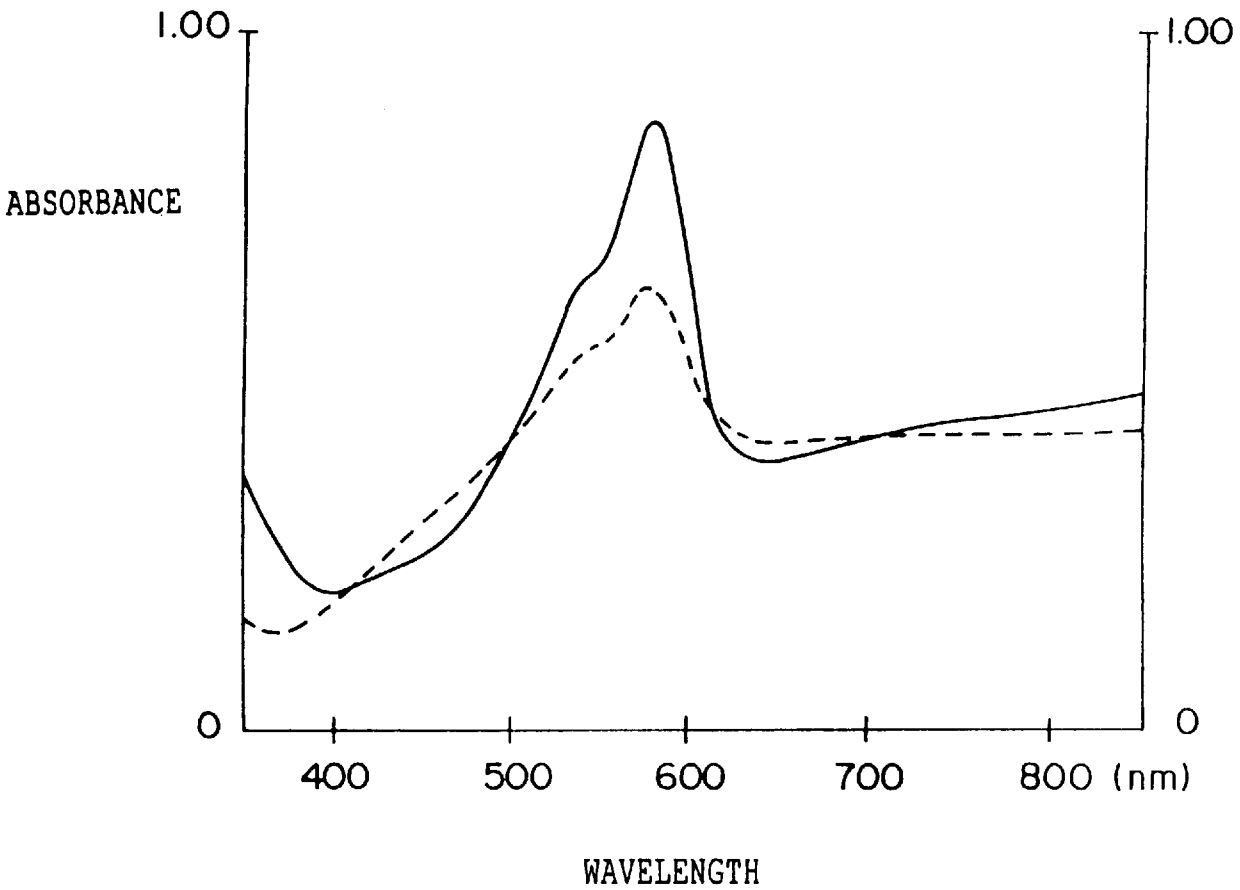
FIG. 4 shows graphs illustrating the doping of rose bengal into a polypyrrole film and the dedoping of rose bengal from the polypyrrole film formed by carrying out polymerization in the presence of rose bengal.

FIG. 4 shows absorption spectra (continuous line) of a thin film of an electroconductive polymer (a polypyrrole film) formed on ITO by polymerization in the presence of rose bengal, and absorption spectra (broken line) after the application of a voltage of −1.0 V for 30 seconds to the thin film on ITO. Accordingly, the continuous line in FIG. 4 shows the state of the thin film of the electroconductive polymer doped with the rose bengal, while the broken line illustrates the dedoping of the rose bengal from the thin film of the electroconductive polymer. It is apparent from FIG. 4 that the dedoping level of the rose bengal is about 50 percent. However, when the −0.1 V is applied to the film for 30 seconds on platinum, which is more stable and has a lower resistivity, almost all of the rose bengal is dedoped. According to a quantitative evaluation, 5 monomer units of the polypyrrole are doped with one molecule of the rose bengal.

Figure 5:
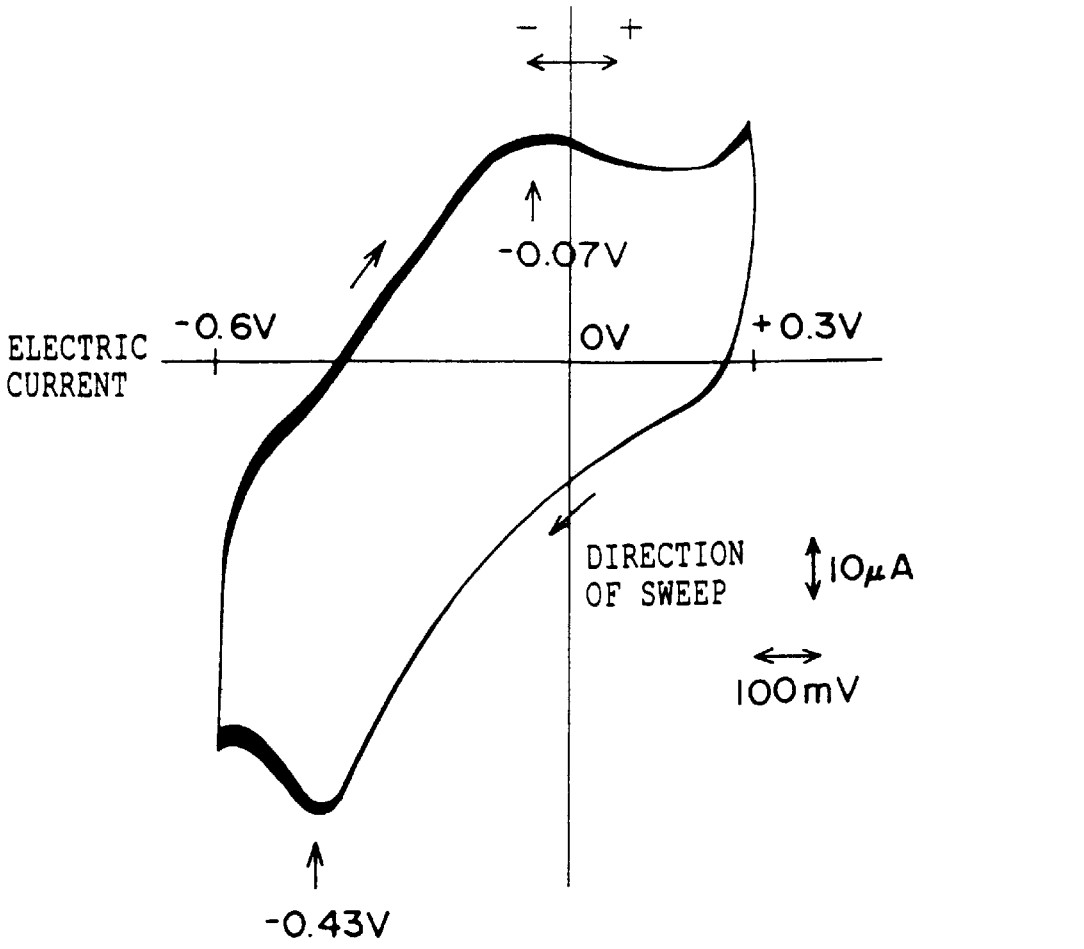
FIG. 5 shows a cyclic voltamgram of a polypyrrole film formed by carrying out polymerization in an aqueous solution of rose bengal.
Figure 6:
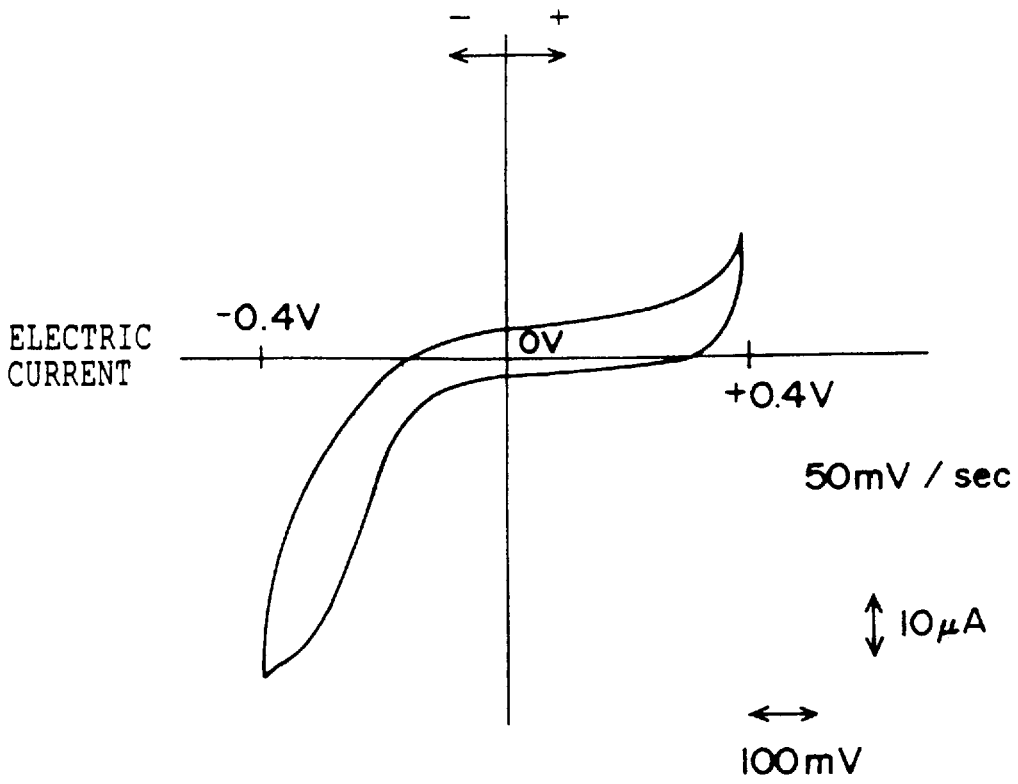
FIG. 6 shows a cyclic voltamgram of a polypyrrole film in an aqueous solution of rose bengal formed by carrying out polymerization in the presence of NaCl.

FIG. 5 shows a cyclic voltamgram in an aqueous solution of rose bengal of a thin film of an electroconductive polymer (a polypyrrole film) formed by polymerization in the presence of rose bengal. This curve was obtained by placing the polypyrrole film formed on platinum in an aqueous solution of rose bengal and applying sweeping potentials repeatedly between plus and minus versus a saturated calomel electrode (reference) to observe current. FIG. 6 shows a cyclic voltamgram in an aqueous solution of rose bengal of a thin film of an electroconductive polymer (a polypyrrole film) formed by polymerization in the presence of NaCl. Potentials were repeatedly changed at the same sweep speed to observe flow of current.

According to FIG. 5, a peak current due to oxidation is observed at −0.07 V and a peak current due to reduction is observed at −0.43 V. FIG. 5 indicates that a film made by polymerization in the presence of rose bengal is reversibly oxidized and neutralized (reduced) in an solution of rose bengal and indicates the reversible doping/dedoping of rose bengal. FIG. 6 shows a cyclic voltamgram almost free of bulge, thereby indicating that the thin film of the electroconductive polymer (a polypyrrole film) formed by polymerization in the presence of NaCl, cannot be sufficiently oxidized or reduced in the aqueous solution of rose bengal. That is, the capability of rose bengal to enter or leave the polymer matrix, i.e., doping or dedoping characteristic, is lower than that in the case shown in FIG. 5. Accordingly, the cyclic voltamgram highlights distinctive doping/dedoping behaviors of an anionic dye molecule into the thin film of the electroconductive polymer.

Referring now to the drawings, the principle of the image forming method of the present invention, which is also described in the prior application, is explained below.

First, an image forming method by means of transfer of an anionic dye molecule is explained, and then an image forming method by means of transferof cationic dye molecule is explained.

Figure 7:
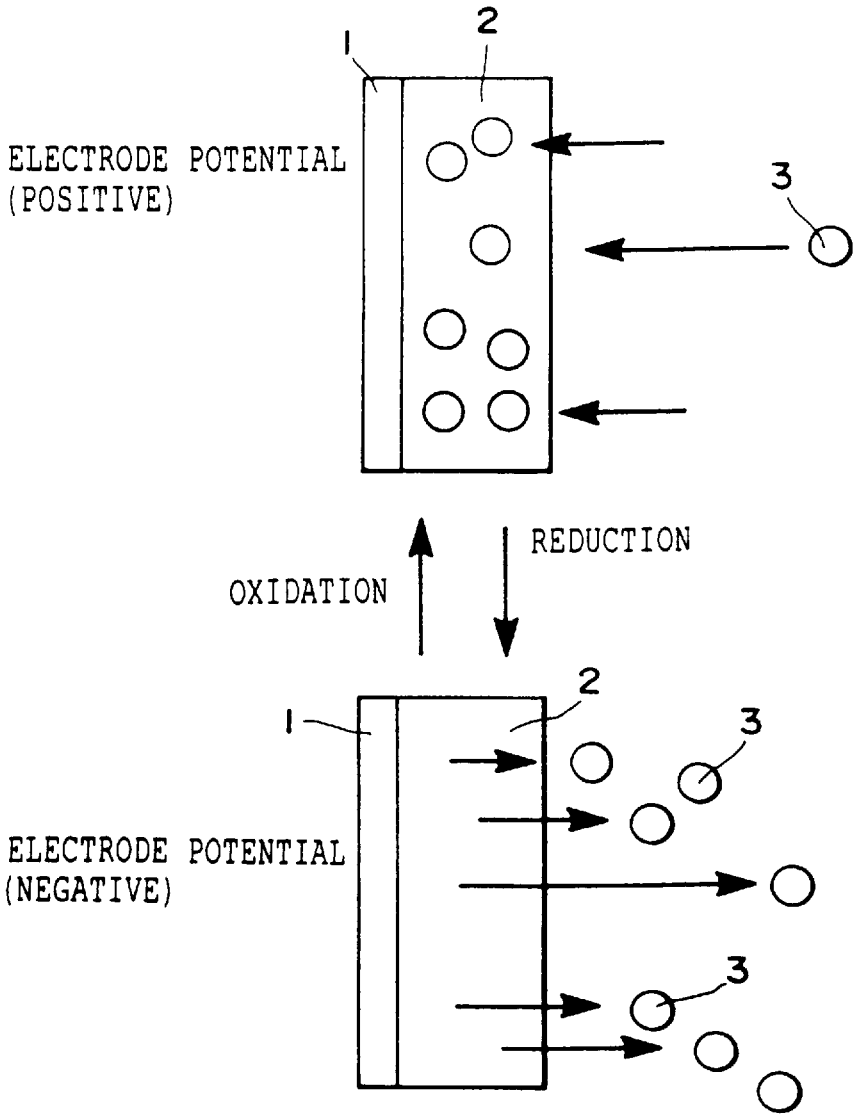
FIG. 7 is a diagram schematically illustrating the principle of the present invention in the case where an anionic dye is used.

In FIG. 7, numeral 1 is a substrate electrode, numeral 2 is a thin film of an electroconductive polymer (π-conjugated polymer) and numeral 3 is anionic dye molecules. For example, if the electrode potential is made positive and a thin film of an electroconductive polymer 2 is made by an electrolytic oxidizing polymerization, the thin film of the electroconductive polymer 2 is formed on the electrode substrate 1 in an oxidized state and is doped with the anionic dye molecule 3. If a negative potential is applied, the thin film of the electroconductive polymer 2 is electrically neutralized and releases the anionic dye molecule 3, which has been taken in, to keep the electrical neutrality, thus dedoping takes place. Conversely, if the potential of the electrode is made positive, the thin film of the electroconductive polymer 2 resumes an oxidized state and takes in the anionic dye molecule 3 to keep an electrical neutrality.

Figure 8:
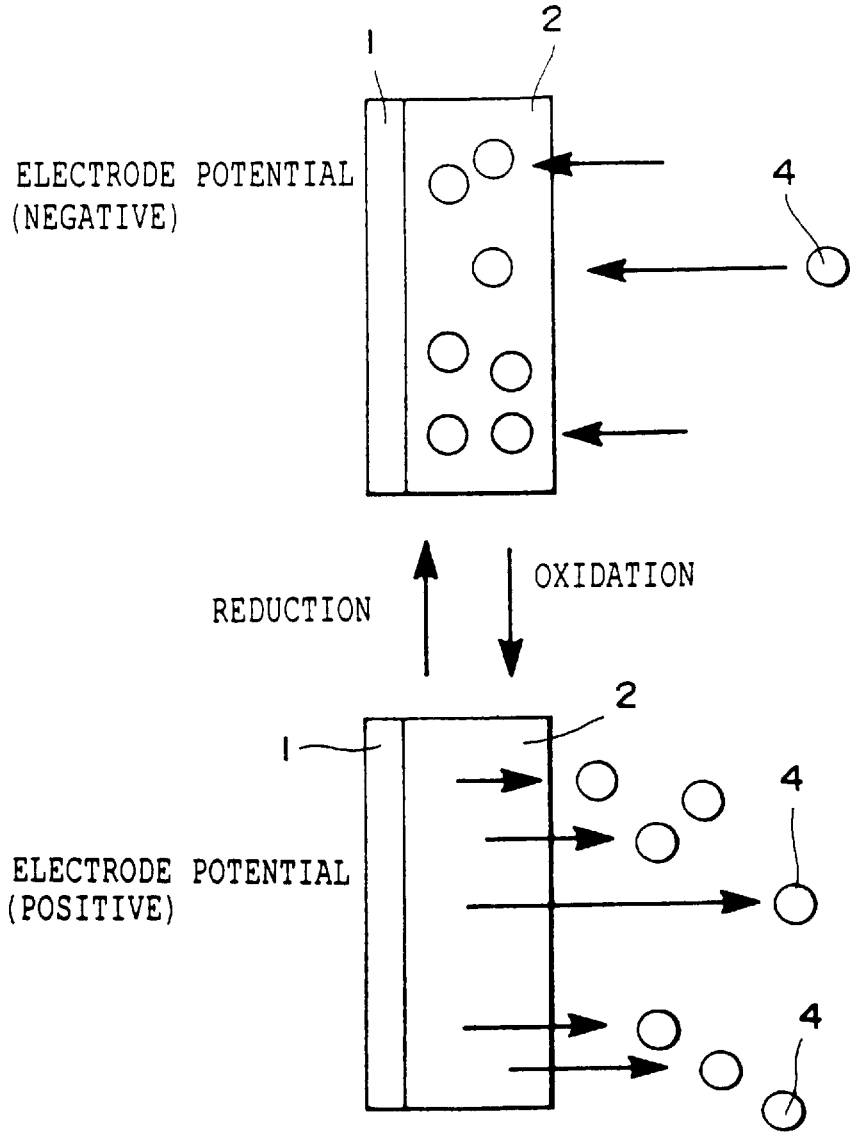
FIG. 8 is a diagram schematically illustrating principle of the present invention in the case where a cationic dye is used.

In FIG. 8, numeral 1 is a substrate electrode, numeral 2 is a thin film of an electroconductive polymer (π-conjugated polymer) and numeral 4 is cationic dye molecules. For example, if the thin film of the electroconductive polymer 2 such as polythiophene is used and the electrode potential is made negative, the thin film of the electroconductive polymer 2 resumes a reduced state and is doped with the cationic dye molecules 4 to keep the electrical neutrality. If the potential of the electrode is made positive, the thin film of the electroconductive polymer 2 is electrically neutralized and releases the cationic dye molecules 4 by dedoping.

The doping amount of the ionic dye molecule can be controlled by the ionic concentration and electroconductivity of dye molecules in the electrolyte solution, the potential of a substrate electrode of a thin film of an electroconductive polymer and the time period of voltage application. The doping amount is basically proportional to the charge amount flowing during the doping. Therefore, the thin film of the electroconductive polymer containing dye molecule ions in a high concentration can be obtained from an oxidation or reduction of the thin film of the electroconductive polymer in an electrolyte solution containing the dye molecule ions by regulating the potential of the substrate electrode. Further, an image depicting the concentration of the dye molecule ions, corresponding to a desired image, can be formed as a distribution of a doping concentration in the thin film of the electroconductive polymer by controlling the potential of the substrate electrode, or by partially controlling an oxidized state or a reduced state of the thin film of the electroconductive polymer.

Meanwhile, the thin film of the electroconductive polymer, which has taken in the dye molecule ions, releases the dye molecule ions when a voltage, whose polarity is reverse to the case for the intake of the dye molecule ions, is applied to the thin film of the electroconductive polymer. In this case, too, the releasing amount of the dye molecule ions can be controlled by the potential of the electrode, an electrical load of an object to be released and the releasing time.

Next, there is shown a simple model (corresponding to the invention described in the prior application) to realize an image forming method utilizing the above-described principle. And, by way of comparison with this model, the image forming method and image forming apparatus of the present invention, which have improved practical applications, will be explained specifically hereinafter.

Figure 9:
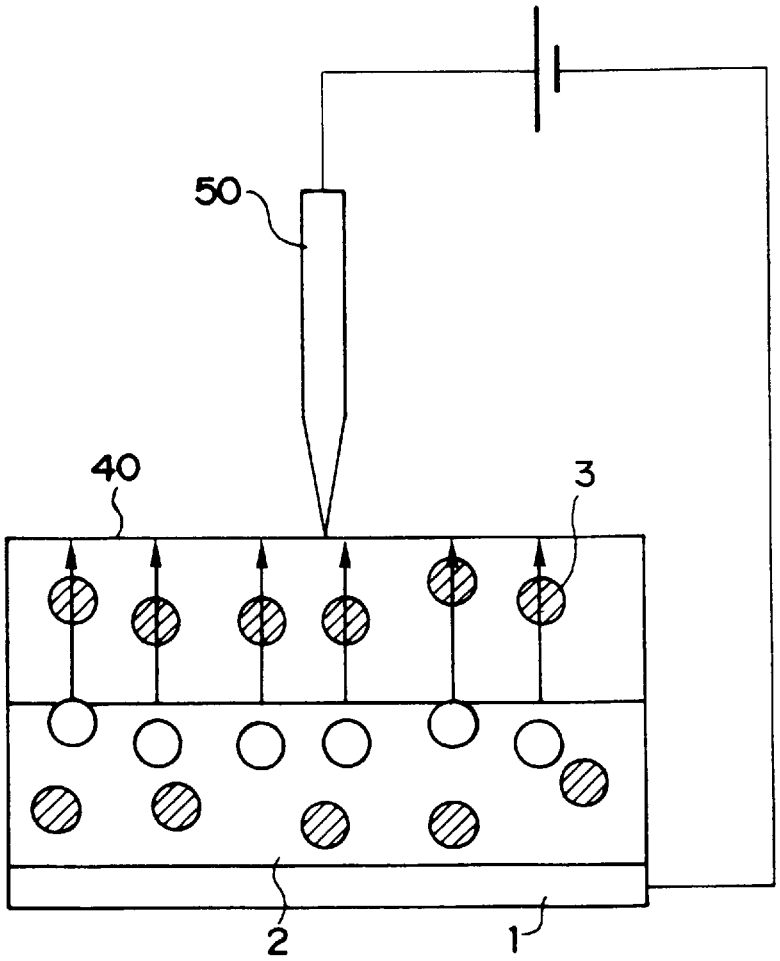
FIG. 9 is a diagram schematically illustrating the method described in the prior application.

FIG. 9 is a schematic diagram illustrating the above-mentioned model. According to this method, an image receiving medium 40 which has a relatively high electroconductivity was used. Therefore, if a voltage was applied to a thin film of an electroconductive polymer 2, which is formed on an electroconductive substrate 1 (functioning as a lower electrode), and to the image receiving medium 40 contacting the thin film of the electroconductive polymer 2, from a needle-like upper electrode 50 (anode) contacting the image receiving medium 40, and from a plate-like electroconductive substrate 1 (cathode) contacting the thin film of the electroconductive polymer 2, the entire surface of the image receiving medium 40 was electrically connected so that the whole surface thereof became equipotential. Accordingly, the whole surface of the thin film of the electroconductive polymer 2 also became equipotential so that the dedoping of the anionic dye 3, i.e., the transfer of the anionic dye 3, took place on the whole surface.

Therefore, for the purpose of transferring an image in the form of a pattern but not whole-surface transfer, it was necessary to array thin films of an electroconductive polymer (pixel) in the form of a matrix formed on fine electroconductive substrates and to apply a voltage independently to each of the pixels.

Figure 10:
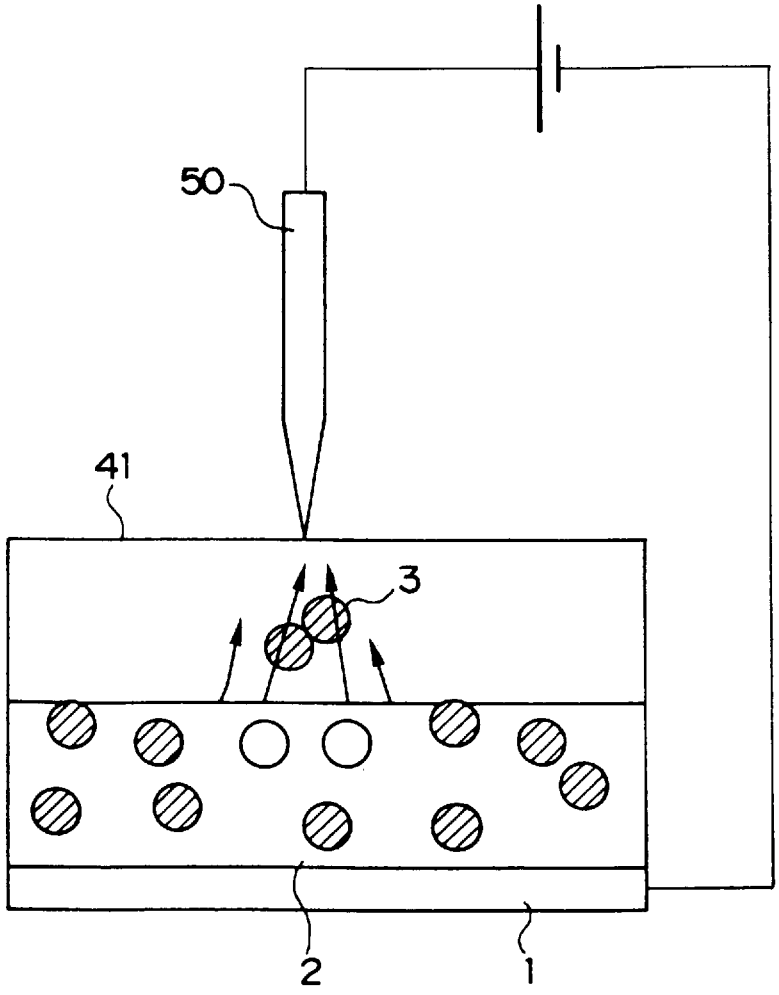
FIG. 10 is a diagram schematically illustrating the method according to the present application.

In the image forming method of the present invention, however, the electroconductivity of the image receiving medium is suppressed or controlled. Therefore, as illustrated in FIG. 10, if a voltage is applied to a thin film of an electroconductive polymer 2 formed on an electroconductive substrate 1 (functioning as a lower electrode), and to the image receiving medium 41, which contacts the thin film of the electroconductive polymer 2, from a needle-like upper electrode 50 (anode) contacting the image receiving medium 41, a plate-like electroconductive substrate 1 (cathode) contacting the thin film of the electroconductive polymer 2, the applied voltage causes local dedoping (i.e., transfer) of an anionic dye 3 from the thin film of the electroconductive polymer 2 to the image receiving medium 41, because the electric field having a value above a certain level is applied only to the part beneath the needle-like electrode 50 and its neighborhood. That is, since the electroconductivity of the image receiving medium 41 is suppressed, and therefore, the range of the electric field affecting the electroconductive polymer 2 can be regulated, the anionic dye 3 is selectively dedoped (i.e., transfer) from the electroconductive film 2.

Although the transfer of the anionic dye 3 is explained in the above, a selective dedoping of a cationic dye is naturally possible based on substantially same principle.

According to the present invention, it is possible to vary the area of a dye to be transferred by controlling (appropriately changing) the electroconductivity of an image receiving medium. It is also possible to control density and gradation by varying the amount of a dye to be transferred from a unit area of the thin film of the electroconductive polymer.

Further, it is possible to vary the area of a dye transfer and/or to vary the amount of a dye to be transferred from a unit area so that density and gradation are produced by controlling the time period of the application of a voltage and/or the voltage to be applied to the image formation controlling electrode.

As is apparent from the above-described explanation, when performing the transfer of dye by use, for example, of a needle-like electrode, in a localized manner, it is impossible to always limit the degree of suppression of the conductivity of a thin film of an electroconductive polymer to a single range, because a variety of factors are involved which include a voltage to be applied and a time period of the application of the voltage as well as the types of the material, thicknesses and shapes of an image receiving medium. However, in light of the voltage to be applied, in the method of the present invention, the electroconductivity of the image receiving medium is suppressed so that the electric field does not extend at least to the entire area of the image receiving medium to realize the state where the localized release and transfer of dye takes place only in the area where the image receiving medium to which an electric field exceeding a certain value affects. Naturally, the electroconductivity should not be suppressed such that the transfer of the dye is impossible in a desired area at a voltage to be applied. In short, the degree of the suppression of the electroconductivity of the image receiving medium should be determined in light of the entire scope of the essential steps of the present invention.

Examples of an image receiving media having a suppressed electroconductivity will be explained below.

An image receiving medium needs to receive a dye and hold it therein. For this purpose, materials such as paper, fabric, non-woven fabric, polymer film and a material made by coating one of such materials onto an appropriate medium (e.g., glass, transparent film, paper, semiconductor or metal) can be used.

An image receiving medium, which is suitable for receiving a dye, holding it and for suppressing the electroconductivity, is made by impregnating or coating one of the above-described media with an electrolyte solution.

From the viewpoint of shortening the transfer time, reducing the voltage required for the transfer and enhancing the resolution, the resistivity of the electrolyte solution is normally not less than 15 MΩ and preferably not less the 17 MΩ.

A resistivity of the electrolyte solution of less than 15 MΩ will somewhat reduce the resolution, but such a resistivity may be preferred from the viewpoint of reducing the voltage required for the transfer and shortening the transfer time.

Examples of the electrolyte solutions usable in the present invention are an aqueous solution and an organic solvent. More specifically, pure water containing a trace of an electrolyte and a solution having a resistivity in the range of several kΩ to tens of MΩ prepared by diluting a pH buffer solution, such as an oxalate pH standard solution (pH=1.68), a phthalate solution (pH=4.01), a neutral phosphate solution (pH=6.86), a phosphate solution (pH=7.41), a borate solution (pH=9.18), a carbonate solution (pH=10.01) and $Na_2HPO_4$-NaOH solution (pH=12), with 1–80 weight percent of pure water having a resistivity in the range of several MΩ to tens of MΩ.

Although the thickness of an image receiving medium varies with the material to be used, the thickness is normally not greater than 60 μm, preferably not greater than 50 μm, most preferably not greater than 30 μm for the purpose of shortening the transfer time, reducing the voltage required for the transfer and enhancing the resolution.

Further, from the viewpoint of the strength of the image receiving medium, the thickness thereof is preferably more than 60 μm.

In the image forming method of the present invention, such factors as a voltage to be applied, a time period of application of the voltage and an electrode diameter may be varied to exert an influence on the resolution and the like.

For example, the time required for transfer can be shortened by increasing a voltage to 3 V or above and the resolution can be enhanced by diminishing the electrode diameter. However, a larger electrode diameter is advantageous in light of the machining of the electrode and the controlling of a voltage to be applied.

In short, the results or workability of the present invention, such as the transferred state of dye or resolution, may be optimized to meet the objective by adjusting at least one of the factors such as the electroconductivity and thickness of an image receiving medium, a voltage to be applied, a time period of application of the voltage and the diameter of an image formation controlling electrode.

Furthermore, a plurality of image receiving media having different electroconductivities may be prepared for a transfer process so that one of the media having a lower electroconductivity receives by transferring a part of the dye and the other having a higher electroconductivity receives by transferring a part or all of the rest of the dye. In this way, a negative-type image formation can be performed easily.

Figure 11:
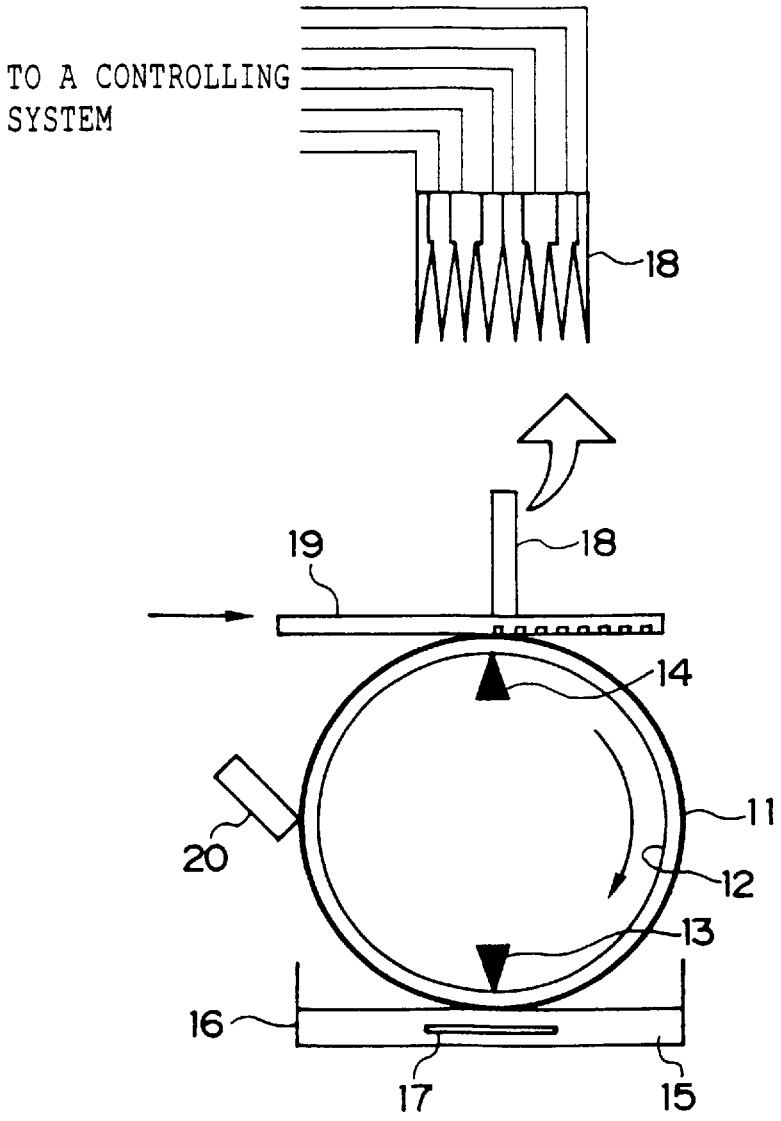
FIG. 11 is a diagram schematically illustrating an apparatus by which the method of the present invention is implemented in a continuous manner.

As explained above, according to the image forming method and apparatus of the present invention, an image pattern can be transferred by use of a needle-like electrode. However, other modes for pattern transfer are possible. For example, an image pattern can be transferred by means of an image forming apparatus schematically shown in FIG. 11. In this apparatus, in the inside of an electrode cylinder 12, on the surface of which a thin film of an electroconductive polymer 11 is formed, there are provided an intake potential driving electrode 13, which is utilized for the intake of an ionic dye molecule into the thin film of the electroconductive polymer 11, and a transfer potential driving electrode 14, which is utilized for the release of an ionic dye molecule taken into the thin film of the electroconductive polymer, in such a manner that the two electrodes are positioned apart from each other at a rotational angle of 180°. Beneath the electrode cylinder 12, there is a tank 16 which stores a dye electrolyte solution 15 containing ionic dye molecules dissolved therein. An opposed intake electrode 17 is positioned in the tank 16 so that the opposed electrode faces the intake potential driving electrode 13. An opposed transfer electrode 18 (corresponding to an image formation controlling electrode) is positioned so as to maintain a predetermined gap from the surface of the electrode cylinder 12. A transfer paper 19 serving as an image receiving medium can be inserted between the electrode cylinder 12 and the opposed transfer electrode 18. In addition, a cleaning blade 20 is positioned so that it contacts the electrode cylinder 12.

As is shown schematically by enlargement, the opposed transfer electrode 18 is a comb-shaped electrode made up by a plurality of needle-like electrodes connected to a plurality of wires, each of which can performon-and-off control of an electric current.

According to this image forming apparatus, a voltage sufficient for the intake of the ionic dye molecule is applied between the intake potential driving electrode 13 and the opposed intake electrode 17 so that the ionic dye molecule in the dye electrolyte solution 15 is taken into the thin film of the electroconductive polymer 11 in the whole of a predetermined area on the electrode cylinder 12. Then, an excess solution on the electrode cylinder 12 is removed by the cleaning blade 20. As the electrode cylinder 12 rotates, a voltage sufficient for the release of the ionic dye molecule, which has been taken into the thin film of the electroconductive polymer 11, is applied between the transfer potential driving electrode 14 and one desired electrode out of the comb-shaped, opposed transfer electrodes 18 which are controlled by a controlling system (not shown) having an arithmetic circuit comprising CPU, ROM, RAM or the like. As a result, the ionic dye molecule is transferred to a predetermined region of the surface of the transfer paper 19, thereby forming an image.

According to the above-described image forming apparatus, a desired image can be formed by doping an ionic dye molecule into the thin film of the electroconductive polymer 11 utilizing the intake potential driving electrode 13 positioned in the electrode cylinder 12 and by dedoping the ionic dye molecule from the thin film of the electroconductive polymer 11 utilizing a desired unit electrode within the comb-shaped, opposed transfer electrodes 18. Further, it is possible to form the image continuously if an electrolyte solution containing an ionic dye molecule is supplied so that the solution is always contained in the tank 16.

The working mechanism of the above-described apparatus is similar to that of a known thermal transfer printer. Since driving means and driving circuits currently used can be applicable to the apparatus of the present invention, the image formation utilizing a thin film of an electroconductive polymer can be realized in a simple and economical way.

If the image formation controlling electrode is made in a pen shape, the pen-shaped electrode can be used as a writing pen, which enables direct transfer of an image by means of a pen input.

Figure 12:
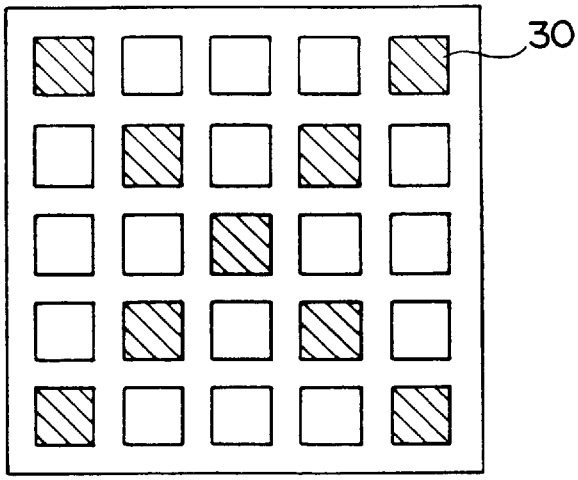
FIG. 12 is a diagram schematically illustrating the image formation controlling electrodes in the form of a matrix.
Figure 13:
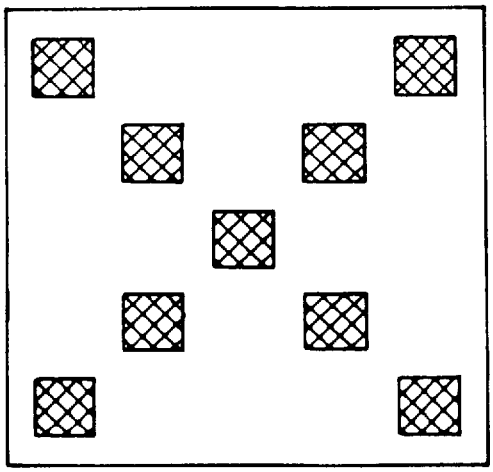
FIG. 13 is a diagram schematically illustrating an example of a transferred image pattern by means of the electrodes of FIG. 12.

In addition, electrodes in the shape of a matrix can be used as an image formation controlling electrode. In this case, an image forming medium having a simple construction can be used, although the driving circuit for the image formation controlling electrodes cannot be simplified. FIG. 12 schematically illustrates an example of the electrodes in the shape of a matrix, where the same number of rectangular electrodes are arrayed in the lengthwise and widthwise directions. An image pattern as shown in FIG. 13 can be transferred by applying a voltage to desired electrodes 30 (indicated by slant lines) in conformance with an image pattern.

EXAMPLES

The present invention is further explained by way of examples.

Example 1

(the effect of the case where the electroconductivity of an image receiving medium is controlled in accordance with a voltage to be applied)

Figure 14:
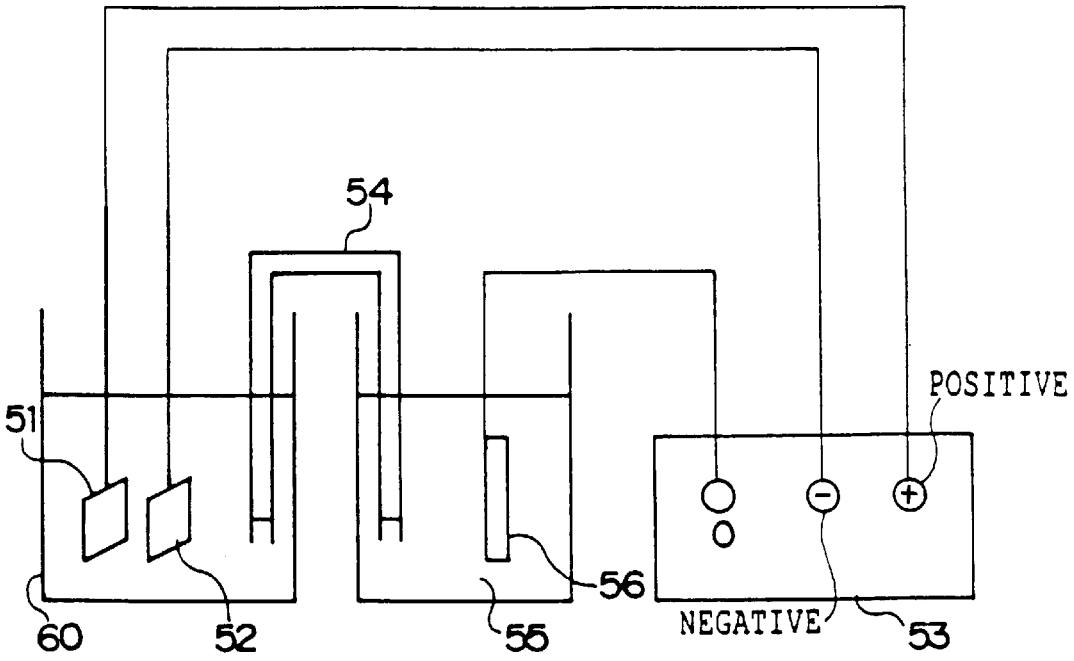
FIG. 14 is a diagram schematically illustrating a set for the preparation of the image forming media utilized in Examples.

As illustrated in FIG. 14, a three-electrode set for an electrolytic polymerization was prepared as generally employed in the art. A platinum working electrode 51 and a platinum opposed electrode 52, conductively linked to plus and minus, respectively, of a potentiostat 53, were immersed in a vessel 60 containing an aqueous solution of pyrrole and rose bengal as a dye. In a KCl aqueous solution, which communicates with the solution in the vessel 60 via a salt bridge 54, there was immersed a reference calomel electrode 56, which was conductively linked to 0 potential of the potentiostat 53.

In the above-identified set, application of a voltage to hold the platinum working electrode at +0.8 V for 30 seconds versus the saturated calomel electrode, in an aqueous solution containing 0.06M of pyrrole and 0.02M of rose bengal, produced a polypyrrole thin film on the platinum electrode (electroconductive substrate) as a result of an electrolytic polymerization of the pyrrole. Since this polypyrrole thin film was doped with the rose bengal, the thin film exhibited magenta color. The electrode coated with a polypyrrole thin film (an image forming medium) was washed with pure water. Then, the coated electrode was brought into close contact with a 130 $\mu$m-thick filter paper which had been dipped in a 0.1N NaCl aqueous solution having a resistivity of 50 Ω (because of the relation with the voltage to be applied and other factors, this filter paper is not "an image receiving medium having a suppressed conductivity" as defined in the present invention) and, thereafter, a needle-like electrode was brought into contact with the surface of the filter paper. Application of a voltage of 3.5 V for 5 seconds between the needle-like electrode which was positive, and the polypyrrole-coated electrode caused the dedoping of the dye from the entire surface of the polypyrrole film, thereby coloring the filter paper in the same shape as the polypyrrole-coated electrode.

In addition, the coated electrode was brought into close contact with a 130 $\mu$m-thick filter paper which had been dipped in a pure water having a resistivity of not less than 17 MΩ (this filter paper corresponds to "an image receiving medium having a suppressed electroconductivity" as defined in the cresent invention) and, thereafter, a needle-like electrode was brought into contact with the surface of the filter paper. Application of a voltage of 3.5 V for 5 seconds between the needle-like electrode which was positive, and the polypyrrole-coated electrode caused the dedoping of the rose bengal to provide a spot on the filter paper, thereby presenting the same shape as that of the needle electrode. This phenomenon evidences that, if the electroconductivity of an image receiving medium is suppressed to a small value, an image pattern can be formed electrically by use of an electrode coated with polypyrrole which is an electroconductive polymer.

Example 2

(the effect of the time period of the application of voltage)

An electrode coated with a polypyrrole thin film (an image forming medium) exhibiting magenta color was obtained as in Example 1. The coated electrode was washed with pure water. Then, the coated electrode was brought into close contact with a 130 μm-thick filter paper which had been dipped in a pure water having a resistivity of not less than 17 MΩ and, thereafter, a needle-like electrode was brought into contact with the surface of the filter paper. A voltage of 3.5 V was applied for the time periods of 5 seconds, 15 seconds and 30 seconds, respectively, between the needle-like electrode which was positive, and the polypyrrole-coated electrode. The observed result was that the diameter of the transferred spot became larger and the density of the transferred dye increased as the time period of the application of voltage became longer.

Example 3

(the effect of the voltage applied)

An electrode coated with a polypyrrole thin film (an image forming medium) exhibiting magenta color was obtained as in Example 1. The coated electrode was washed with pure water. Then, the coated electrode was brought into close contact with a 130 μm-thick filter paper which had been dipped in a pure water having a resistivity of not less than 17 MΩ and, thereafter, a needle-like electrode was brought into contact with the surface of the filter paper. Voltages of 2.5 V, 3 V and 3.5 V were applied, respectively, for 30 seconds between the needle-like electrode which was positive, and the polypyrrole-coated electrode. The observed result was that the diameter of the transferred spot became larger and the density of the transferred dye increased as the voltage applied became larger.

Example 4

(the effect of the thickness of the image receiving medium)

An electrode coated with a polypyrrole thin film (an image forming medium) exhibiting magenta color was obtained as in Example 1. The coated electrode was washed with pure water. Then, the coated electrode was brought into close contact with two sheets of filter paper having a thickness of 130 μm and 55 μm, respectively, which had been dipped in a pure water having a resistivity of not less than 17 MΩ and, thereafter, a needle-like electrode was brought into contact with the surface of the filter paper. A voltage of 3 V was applied for 10 seconds between the needle-like electrode which was positive, and the polypyrrole-coated electrode. The observed result was that the paper having a thickness of 130 μm produced a lower transfer density and more bleeding at the edge and the paper having a thickness of 55 μm produced a higher density and a lesser level of bleeding at the edge.

Example 5

(the effect of the thickness of the image receiving medium, the voltage applied and the time period of the application of voltage)

An electrode coated with a polypyrrole thin film (an image forming medium) exhibiting magenta color was obtained as in Example 1. The coated electrode was washed with pure water. Then, the coated electrode was brought into close contact with two sheets of filter papers having a thickness of 130 μm and 55 μm, respectively, which had been dipped in a pure water having a resistivity of not less than 17 MΩ and, thereafter, a needle-like electrode was brought into contact with the surface of the filter papers. A voltage of 2 V was applied for 30 seconds between the needle-like electrode which was positive, and the polypyrrole-coated electrode. The observed result was that the paper having a thickness of 130 μm produced almost no transfer of the dye and the paper having a thickness of 55 μm produced a transfer of the dye.

Example 6

(formation of a pattern by means of a needle-like electrode)

An electrode coated with a polypyrrole thin film (an image forming medium) exhibiting magenta color was obtained as in Example 1. The coated electrode was washed with pure water. Then, the coated electrode was brought into close contact with a filter paper having a thickness 55 μm which had been dipped in pure water having a resistivity of not less than 17 MΩ and, thereafter, a needle-like electrode was brought into contact with the surface of the filter paper. The needle-like electrode was moved while a voltage of 3 V was applied between the needle-like electrode which was positive, and the polypyrrole-coated electrode, and the pattern was transferred to the paper. The time period of the application of the voltage was 10 seconds. Next, after having been used for the pattern transfer, the coated electrode was brought into close contact with a 130 μm-thick filter paper which had been dipped in a 0.1N NaCl aqueous solution and, thereafter, an upper electrode was brought into contact with the surface of the filter paper. Application of a voltage of 3.5 V for 20 seconds between the upper electrode which was positive, and the polypyrrole-coated electrode caused the dedoping of the dye from the polypyrrole film, thereby transferring to the filter paper a negative pattern corresponding to the pattern which had been transferred previously.

Example 7

(formation of a pattern by means of a needle-like electrode and use of other image receiving medium)

An electrode coated with a polypyrrole thin film (an image forming medium) exhibiting magenta color was obtained as in Example 1. The coated electrode was washed with pure water. Then, the coated electrode was brought into close contact with a filter paper having a thickness 55 μm which had been dipped in pure water having a resistivity of not less than 17 MΩ and, thereafter, a needle-like electrode was brought into contact with the surface of the filter paper. The needle-like electrode was moved while a voltage of 3 V was applied between the needle-like electrode which was positive, and the polypyrrole-coated electrode, and the pattern was transferred to the paper. The time period of the application of the voltage was 10 seconds. Next, after having been used for the pattern transfer, the coated electrode was brought into close contact with a 130 μm-thick filter paper which had been dipped in an alkaline buffer solution having a pH value of 10.1. The result was that the dye was dedoped from the polypyrrole film and a negative pattern corresponding to the pattern, which had been transferred previously, was transferred to the filter paper.

Example 8

(formation of a pattern by means of a matrix of electrodes)

An electrode coated with a polypyrrole thin film (an image forming medium) exhibiting magenta color was obtained as in Example 1. The coated electrode was washed with pure water. Then, the coated electrode was brought into close contact with a filter paper having a thickness 55 μm which had been dipped in a pure water having a resistivity of not less than 17 MΩ and, thereafter, a matrix of electrodes was brought into contact with the surface of the filter paper. A voltage of 3 V was applied for 10 seconds between desired electrodes which were employed as positive electrodes in the matrix, and the polypyrrole-coated electrode. As a result, as illustrated in FIG. 13, the filter paper was colored in the same shape as the pattern to which the voltage was applied. This result confirms that a pattern can be formed by a selective dye transfer as a result of localized application of an electric field to a polypyrrole film, which contains a dye, utilizing desired electrodes in a matrix.

The image forming method and image forming apparatus of the present invention, which utilize a thin film of an electroconductive polymer capable of holding or releasing a dye by means of an electric field, can drastically simplify the construction comprising a driving circuit, a driving means and an image forming medium to be used for the transfer of image pattern. Further, since the elements for conventional image forming apparatus (e.g., thermal transfer printer) can be used for the image forming method and image forming apparatus of the present invention, the implementation of the method of the present invention is not expensive and also the cost of the apparatus of the present invention is low.

What is claimed is:

1. An image forming method comprising the steps of:

forming a thin film of an electroconductive polymer on an electroconductive substrate, which is capable of taking in, holding and releasing an ionic dye molecule in accordance with a change in the state of the electroconductive polymer, which is capable of assuming at least two physicochemical states among an oxidized state, a neutral state and a reduced state;

bringing the thin film of the electroconductive polymer into contact with an image receiving medium, that can receive the ionic dye molecule by transfer and has a suppressed electroconductivity; and applying a voltage corresponding to an image signal, to an image formation controlling electrode arranged such that the thin film of the electroconductive polymer holding the ionic dye molecule and the image receiving medium are disposed between the image formation controlling electrode and the electroconductive substrate, so as to release and transfer the ionic dye molecule being held in the thin film of the electroconductive polymer, to the image receiving medium, thereby forming a dye image.

2. The image forming method of claim 1, comprising suppressing the electroconductivity of the image receiving medium to such an extent that the voltage applied to the image formation controlling electrode produces an electric field which extends over only a portion of an area of the image receiving medium, so that the ionic dye molecule is partially released from the thin film of the electroconductive polymer.

3. The image forming method of claim 1, comprising controlling the area of the ionic dye molecule to be transferred by controlling the electroconductivity of the image receiving medium.

4. The image forming method of claim 1, comprising controlling the amount of the ionic dye molecule transferred from a unit area of the thin film of the electroconductive polymer by controlling the electroconductivity of the image receiving medium.

5. The image forming method of claim 1, comprising forming an image having a density and gradation on the image receiving medium by controlling at least one of a time period of application of the voltage and the amount of the voltage to be applied to the image formation controlling electrode.

6. The image forming method of claim 5, wherein the image formation controlling electrode comprises a comb-like electrode including a plurality of needle-like electrodes, and the method comprises selectively applying an electric current to a desired needle-like electrode.

7. The image forming method of claim 6, wherein the electroconductive substrate and the thin film of the electroconductive polymer formed on the substrate have a cylindrical shape, and the method comprises rotating the electroconductive substrate and the thin film to produce a pattern in a continuous manner.

8. The image forming method of claim 5, wherein the image formation controlling electrode comprises an array of electrodes in the form of a matrix.

9. The image forming method of claim 1, wherein the image formation controlling electrode is a pen-shaped electrode.

10. The image forming method of claim 1, wherein the image receiving medium includes a plurality of image receiving media having different electroconductivities, and the method comprises transferring the ionic dye molecule to one of the image receiving media having a lower electroconductivity and thereafter, transferring at least a part of a remainder of the ionic dye molecule to other image transfer media having a higher electroconductivity, in succession.

11. The image forming method of claim 1, comprising coating or impregnating the image receiving medium with an electrolyte solution having a suppressed electroconductivity.

12. The image forming method of claim 11, wherein the electrolyte solution is an aqueous solution having a resistivity of not less than 15 MΩ.

13. The image forming method of claim 1, wherein the image receiving medium has a thickness of not greater than 50 $\mu$m.

14. An image forming apparatus comprising:

an image forming medium including an electroconductive substrate and a thin film of an electroconductive polymer formed on the electroconductive substrate and capable of taking in, holding and releasing an ionic dye molecule in accordance with the state of the electroconductive polymer, which is capable of assuming at least two physicochemical states among an oxidized state, a neutral state and a reduced state;

an image receiving medium, which can be brought into contact with the thin film of the electroconductive polymer and which can receive the ionic dye molecule by transfer, the image receiving medium having a suppressed electroconductivity; and an image formation controlling electrode arranged such that the thin film of the electroconductive polymer holding the ionic dye molecule and the image receiving medium are disposed between the image formation controlling electrode and the electroconductive substrate.

15. The image forming apparatus of claim 14, wherein the image receiving medium has suppressed electroconductivity such that the voltage applied to the image formation controlling electrode produces an electric field which extends over only a portion of an area of the image receiving medium, so that the ionic dye molecule is partially released from the thin film of the electroconductive polymer.

16. The image forming apparatus of claim 15, wherein the image formation controlling electrode is a comb-like electrode comprising a plurality of needle-like electrodes and, wherein an electric current can selectively be applied to a desired needle-like electrode.

17. The image forming apparatus of claim 15, wherein an the image formation controlling electrode comprises an array of electrodes in the form of a matrix.

18. The image forming apparatus of claim 14, wherein the electroconductive substrate is cylindrical to allow the image forming medium to be cylindrical, the image forming medium being rotatably arranged so that an image pattern can be formed in a continuous manner.

19. The image forming apparatus of claim 14, wherein the image formation controlling electrode is a pen-shaped electrode.

20. The image forming apparatus of claim 14, wherein the image receiving medium is coated or impregnated with an electrolyte solution having a suppressed electroconductivity.

21. The image forming apparatus of claim 20, wherein the electrolyte solution is an aqueous solution having a resistivity of not less than 15 megohms.

22. The image forming apparatus of claim 14, wherein the image receiving medium has a thickness of not greater than 50 $\mu$m.

* * * * *